US005547316A

United States Patent [19]

Zege et al.

[11] Patent Number: 5,547,316

[45] Date of Patent: Aug. 20, 1996

[54] PREFABRICATED MEMBERS OF SECTIONAL MONOLITHIC WALL IN GROUND, DESIGN OF WALL BUILT UP OF SAID MEMBERS, AND METHOD FOR ERECTION OF SAID WALL

[75] Inventors: Sergei O. Zege, 1 Aeroportovskaya ulitsa, 6, kv.181; Irina A. Zege; Dmitry V. Antonov; Igor I. Sedov; Lev V. Makovsky; Igor A. Pokladok; Arkady J. Mikhailov, all of Moscow, Russian Federation

[73] Assignee: Sergei Olegovich Zege, Moscow, Russian Federation

[21] Appl. No.: 313,079

[22] PCT Filed: Dec. 28, 1993

[86] PCT No.: PCT/RU93/00321

§ 371 Date: Sep. 28, 1994

§ 102(e) Date: Sep. 28, 1994

[87] PCT Pub. No.: WO94/18397

PCT Pub. Date: Aug. 18, 1994

[30] Foreign Application Priority Data

Jan. 29, 1993 [RU] Russian Federation ..... 93003689

[51] Int. Cl.[6] ..... E02D 5/18; E02D 29/02

[52] U.S. Cl. ..... 405/267; 405/287

[58] Field of Search ..... 405/266, 267, 405/275, 286, 287

[56] References Cited

U.S. PATENT DOCUMENTS 4,453,366 6/1984 Picagli ..... 405/267 X

FOREIGN PATENT DOCUMENTS 2236369 1/1975 France ..... 405/267

106014 6/1983 Japan ..... 405/267

1309360 3/1973 United Kingdom .

1481186 7/1977 United Kingdom .

1525445 9/1978 United Kingdom .

2504953 5/1982 United Kingdom .

2192656 1/1988 United Kingdom .

OTHER PUBLICATIONS

*Urban Underground Transport Structures*, L. V. Makovsky, pp. 1–15 (with English Language translation) (1979).

*Erection of Structures Using "Wall in Earth" Method*, Kiev (edited by D.Sc., Prof. A. L. Filakhtov), pp. 141–158 (1976) (with English language translation) (1979).

*Primary Examiner*—David J. Bagnell

*Attorney, Agent, or Firm*—Nath & Associates; Gary M. Nath

[57] ABSTRACT

A system for construction or reconstructing building foundations involving prefabricated members (1) of a sectional monolithic wall in ground comprised of a reinforcing cage and a concrete body with longitudinal curvilinear slots (2) on end faces, offset towards one of the longitudinal sides of the body and forming thicker (3) and thinner (4) projections. The reinforcing cage consists of an external sheet reinforcement (6), cross bars (7) and intersection bars 95) rigidly connected to the sheet reinforcement (6) and to cross bars (7). The cross bars (7) and sheet reinforcement (6) may have free lengths (9, 10, 11). A sectional monolithic wall in ground built up from said prefabricated members (1) is provided with continuous lateral reinforcement at the side opposite to the sheet reinforcement (6). A method for erecting a sectional monolithic wall which involves digging a trench by successive digging runs, installing said prefabricated members (1) with free lengths (9, 10) and said members without free lengths within the limits of a digging run by a certain method, and concreting the monolithic portions of the wall between the adjacent members in a certain sequence of steps.

11 Claims, 3 Drawing Sheets

PREFABRICATED MEMBERS OF SECTIONAL MONOLITHIC WALL IN GROUND, DESIGN OF WALL BUILT UP OF SAID MEMBERS, AND METHOD FOR ERECTION OF SAID WALL

BACKGROUND OF THE INVENTION

1. Field of Art

The present invention relates to civil engineering, particularly to erection of underground structures with a shallow foundation depth, using sectional monolithic walls in ground, based on prefabricated members.

2. Discussion of the Prior Art

Known in the prior art is a method for erecting a wall in ground involving digging a trench and concreting it (see L. V. Makovsky "Urban Underground Transport Structures", 1979, Stroyizdat (Moscow) p.330).

Also known is a prefabricated member of the sectional monolithic wall in ground, comprised of a reinforcing cage and a concrete body provided with longitudinal curvilinear slots on end faces (see A. L. Filatov "Erection of Structures by the "wall-in-ground" method", 1976, Budivelnik, (Kiev), p. 143). The wall built up of these prefabricated members is devoid of continuous cross reinforcement which affects adversely the reliability of the wall, i.e. reduces its lateral stiffness and calls for complicated work if waterproofing in watery ground is required.

The same source gives a description of a sectional monolithic wall in ground comprising prefabricated members having curvilinear longitudinal slots on end faces and concreted monolithic sections of the wall disposed between pairs of adjacent prefabricated members. The method for erecting such a sectional monolithic wall in ground involves digging a trench by a number of digging runs, installing prefabricated members with curvilinear slots on counteropposing sides at a distance from one another within each digging run and concreting the monolithic portions of the wall between the pairs of adjacent prefabricated members.

SUMMARY OF THE INVENTION

The main object of the present invention resides in improving the reliability of the wall by allowing it to take lateral bending moments and simplifying the manufacture of both prefabricated members proper and the entire wall.

This object is attained by the claimed design of the prefabricated members which go to make a sectional monolithic wall in ground, and by the claimed method for erection of said wall.

A specific design feature of the prefabricated member of a sectional monolithic wall in ground, consisting of a reinforcing cage and a concrete body with longitudinal curvilinear slots on end faces, lies in that said longitudinal curvilinear slots are offset towards one of the longitudinal faces of the concrete body and form projections of different thickness, said reinforcing cage being comprised of external sheet reinforcement disposed on the external surface of the longitudinal side of the concrete body at the side of the thinner projections, transverse bars extending in tiers through the height of the body and disposed at the longitudinal face of the body at the side of the thicker projections, and of bars intersecting in each tier at an angle and having bends at the ends which are welded at the side of thinner projections to the external sheet reinforcement while at the side of thicker projections they are secured to the transverse bars.

The prefabricated member of the sectional monolithic wall in ground may have a reinforcing cage provided with longitudinal prestressed reinforcing bars disposed between the bars intersecting at an angle, and an external sheet reinforcement.

The prefabricated member of the sectional monolithic wall may have a reinforcing cage whose transverse bars in each tier have their free lengths protruding beyond the limits of the counteropposed thicker projections and are offset from one another.

The prefabricated member of the sectional monolithic wall in ground may be provided with external sheet reinforcement having free lengths protruding from the concrete body for connection with the free lengths of the similar sheet reinforcement of the adjacent prefabricated members of the wall.

A specific design feature of the sectional monolithic wall in ground comprised of prefabricated members having curvilinear longitudinal slots on end faces and installed at a distance from one another, and concreted monolithic portions of the wall disposed between the pairs of adjacent prefabricated members lies in that the prefabricated members are provided with external sheet reinforcement on one side which is slotless and have free lengths of transverse bars displaced towards one of the longitudinal sides of the body, said free lengths being located at the side remote from the side provided with the sheet reinforcement, the free lengths of the bars of the adjacent prefabricated members being inserted with overlapping into the concrete monolithic portions of the wall to make a continuous lateral reinforcement. The sectional monolithic wall in ground may be provided with covering straps which overlap the monolithic portions and are secured to the sheet reinforcement of the prefabricated members. The wall may have additional prefabricated members which have external sheet reinforcement on one of their faces in the form of separating blocks with centrosymmetrical slots on counteropposing sides, said separating blocks alternating with at least one basic prefabricated member while said basic prefabricated members are provided with devices for fastening the linking structures.

A specific feature of the method for erecting a sectional monolithic wall in ground lies in that said method involves the digging of a trench by a succession of digging runs, installing said prefabricated members in each digging run at a distance from one another with curvilinear slots on opposite sides and concreting the monolithic portions of the wall between the pairs of adjacent prefabricated members, each digging run presupposes the use of one reusable prefabricated member without free lengths of transverse reinforcing bars and at least one prefabricated member with free lengths of said transverse reinforcing bars, the length of said free lengths exceeding half the distance between the prefabricated members, installing a prefabricated members without free lengths of reinforcing bars at the end of each digging run while concreting of the monolithic portion adjoining the last prefabricated member of the digging run is preceded by excavating the ground on the next digging run and installing therein the appropriate prefabricated members after which the last prefabricated member of the preceding digging run is removed and replaced by the prefabricated member with free lengths of reinforcing bars; then the monolithic portions of the wall adjoining said member and the monolithic portions of the wall between the prefabricated members having free lengths of reinforcing bars are concreted while the reusable prefabricated member is utilized in the subsequent digging runs.

After erection of the wall in ground, in the course of ground excavation at the side of the underground structure it is good practice to install covering straps overlapping the monolithic portions of the wall either completely or discretely, fastening them to the sheet reinforcement of adjacent prefabricated members.

BRIEF DESCRIPTION OF THE DRAWINGS

Now the invention will be elucidated by the drawings wherein.

DETAILED DESCRIPTION OF THE PREFERRED EMBODIMENT

Figure 1:
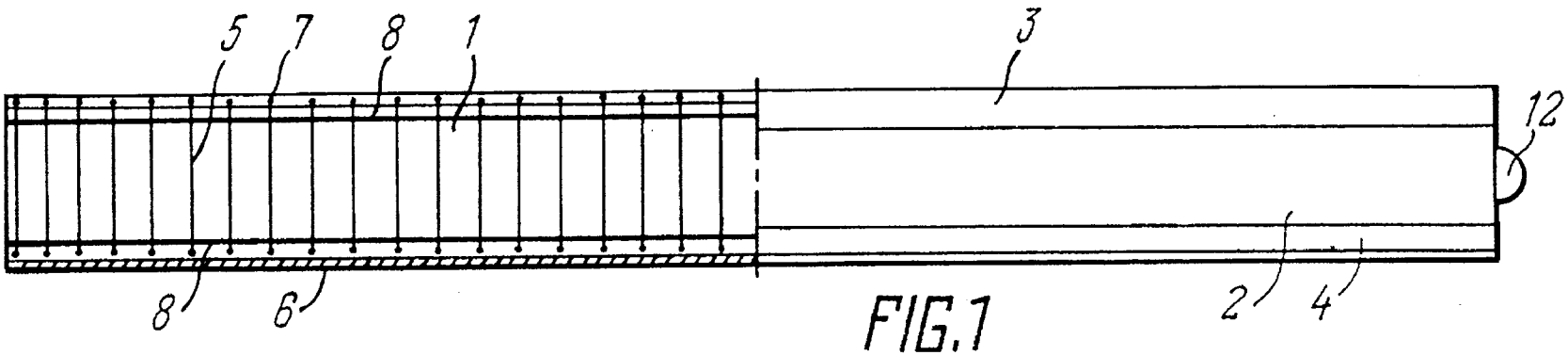
FIG. 1 is the layout of reinforcement with a view of the end face of the prefabricated member.
Figure 3:
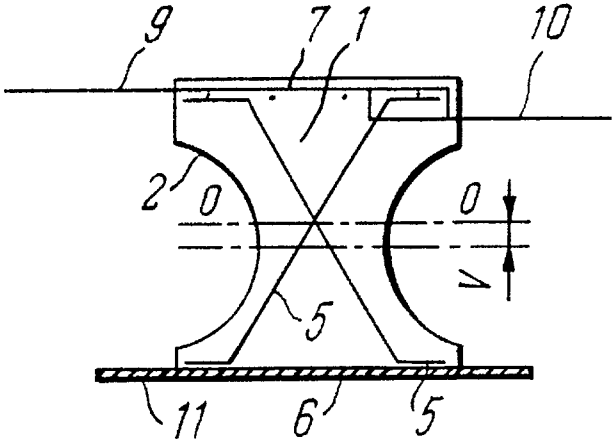
FIG. 3 is a cross-section of the prefabricated member with free lengths of transverse bars arranged in different planes at the side of thicker and thinner projections (free lengths of sheet reinforcement)
Figure 2:
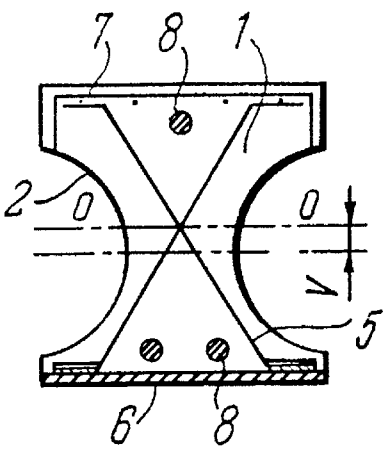
FIG. 2 is a cross-section of the member with longitudinal prestressed bars.
Figure 4:
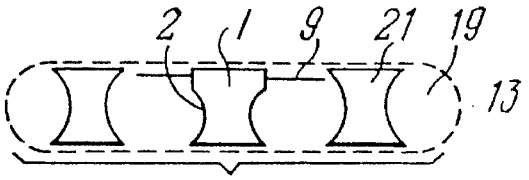
FIG. 4 is the first trench digging run with installed prefabricated members.
Figure 5:
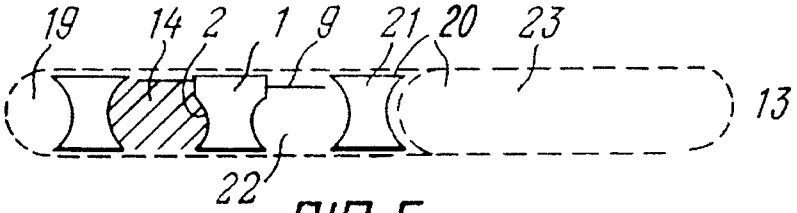
FIG. 5 is the first trench digging run with installed prefabricated members and monolithic portion and excavation of the second trench digging run.
Figure 6:
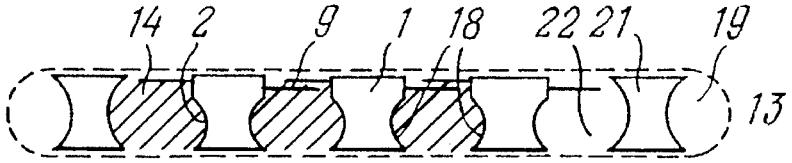
FIG. 6 are trenches with the wall structure built during the first and second digging runs.
Figure 7:
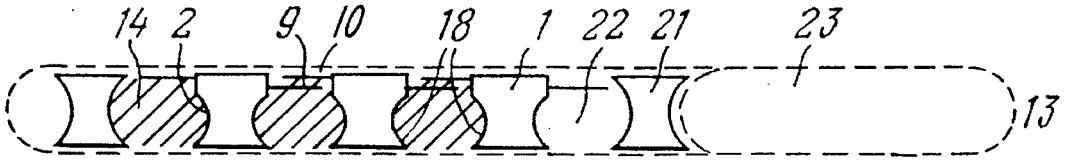
FIG. 7 are trenches with the portion of erected wall during excavation of the third (or any subsequent) digging run.
Figure 8:
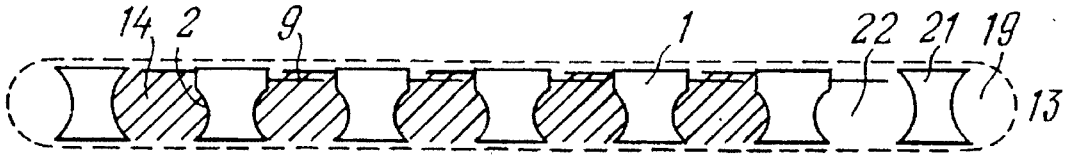
FIG. 8 is a trench with a portion of erection wall and the prefabricated members installed during the last digging run.

The concrete body of the prefabricated member 1 has longitudinal curvilinear slots 2 (see FIGS. 1–3) offset from the longitudinal axis 0—0 and forming thicker 3 and thinner 4 projections, and a reinforcing cage comprised of bars 5 intersecting in each tier at an angle, welded at the side of the thinner projection to the external sheet reinforcement 6 while at the side of thicker projections, to transverse reinforcement 7. Located between bars 5 may be longitudinal prestressed bars 8. The transverse bars of reinforcement 7 may have free lengths 9, 10 at the ends arranged in different planes in plan.

The external sheet reinforcement may have free lengths 11 to connect the body with the sheet reinforcement of the adjacent prefabricated members of the wall. The member may be hoisted with the aid of sling eyes 12.

Manufacture of the prefabricated member is started by welding the bars 5 to the external sheet reinforcement 6 then installing the side sectional walls of the formwork made of tubular members (not shown in the drawings) which may; if necessary, be held together by prestressed bars 8. Tubular members are also used for supply of steam during warm-up of concrete. Installation of the formwork is followed by placing reinforcement 7, concreting, wet-heat treatment and care of concrete. The forms are removed simply by horizontal shifting of their walls. The manufactured members are carried to the building site.

The sectional-monolithic wall in ground 13 is made up of prefabricated members 1 with sheet reinforcement 6 directed into the underground structure, and monolithic portions 14. Said portions 14 may be covered inside the underground structure by continuous covering straps 15 which are secured (after exposure of wall in ground) to the sheet reinforcement 6. The free lengths 9, 10 of transverse bars 7 arranged along face 16 which is disposed remotely from the sheet reinforcement 6 are inserted into the monolithic portions 14 with overlapping which ensures continuous lateral reinforcement of the wall along said face.

When installing the linking structures 17 (FIG. 11) (anchors, struts, etc.) between every one or another odd number of prefabricated members the negative bending moment is originated only in the zone of the prefabricated member which has devices (not shown in the drawings) for fastening the linking structures 17. A transverse moment acting halfway between such prefabricated members stretches only those covering straps 15 which are secured to the sheet reinforcement 6. Without impairing reliability of the wall, the additional prefabricated members 18 may be installed in this zone in the form of separating blocks which have no free lengths on the transverse reinforcing bars.

Thus, irrespective of the fact that the lateral reinforcement is located in this case only above the linking structures, its continuity is also ensured because all the originated tensile forces are duly taken.

Trench 19 is made in the ground 13 (FIGS. 4–8) by successive digging runs 20 in which one or more prefabricated members 1 are installed at a distance from one another with their curvilinear slots 2 on counter-opposed faces with free lengths 9, 10 of the lateral reinforcement, the length of these free lengths being greater than half the distance between the prefabricated members 1. Regardless of the number of prefabricated members 1 in the digging run, the last member should be a reusable prefabricated member 21 without free lengths of the lateral reinforcement but provided with slots 22 on the opposite faces.

Installation of the prefabricated members is followed by concreting the monolithic portions 14 between the prefabricated members 1. Before concreting the monolithic portion 22 of the digging run adjoining the reusable prefabricated member 21, the ground of the next digging run 23 is excavated and appropriate prefabricated members 1 with free lengths 9, 10 of lateral reinforcing bars are installed therein after which the reusable prefabricated member 21 is pulled out of the preceding digging run for use in the following digging operations.

Figure 9:
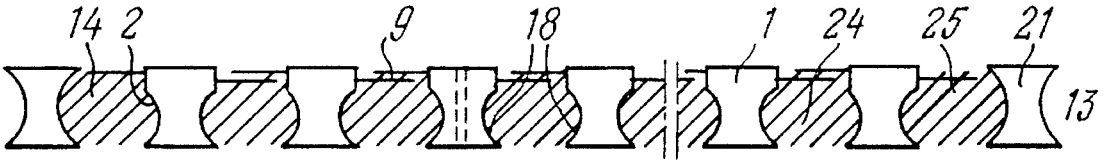
FIG. 9 is the completed wall structure.

The prefabricated member 1 with free lengths 9, 10 of the lateral reinforcing bars is installed in place of the reusable prefabricated member 21 (FIG. 9) then concreting is started of the monolithic portions 24 and 25 adjoining said member 1 and of the monolithic portions 22 in the completed digging run between the installed prefabricated members 1 with the free lengths 9 and 10 of reinforcing bars.

Figure 10:
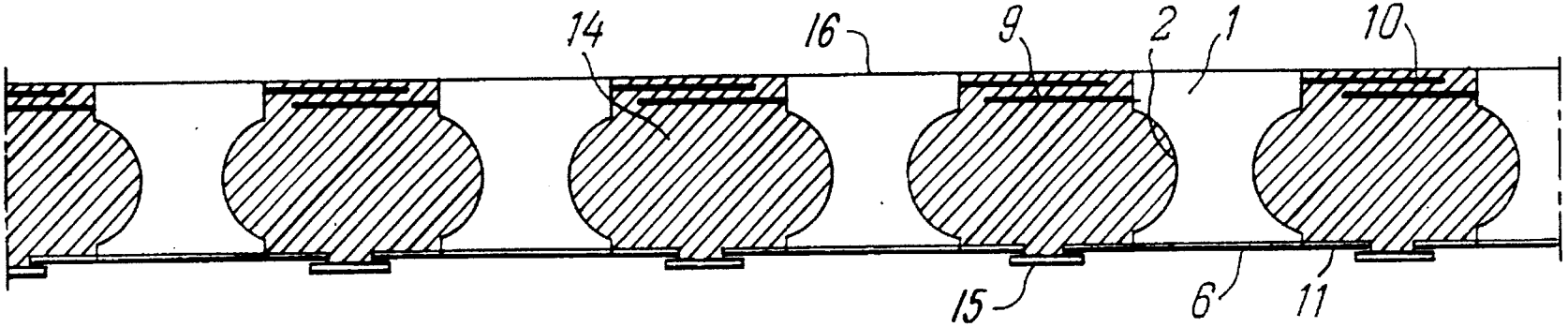
FIG. 10 is the wall structure with continuous two-sided lateral reinforcement, plan view.

FIG. 10 shows the wall in ground in which the provision is made of a continuous lateral reinforcement. It is provided from the interior of an underground structure by securing the continuous straps 15 which are mounted after exposure of wall in ground. Outside of the underground structure along the face 16 of the continuous reinforcement is provided by free lengths 9, 10 being inserted into monolithic portions 14 with overlapping.

Figure 11:
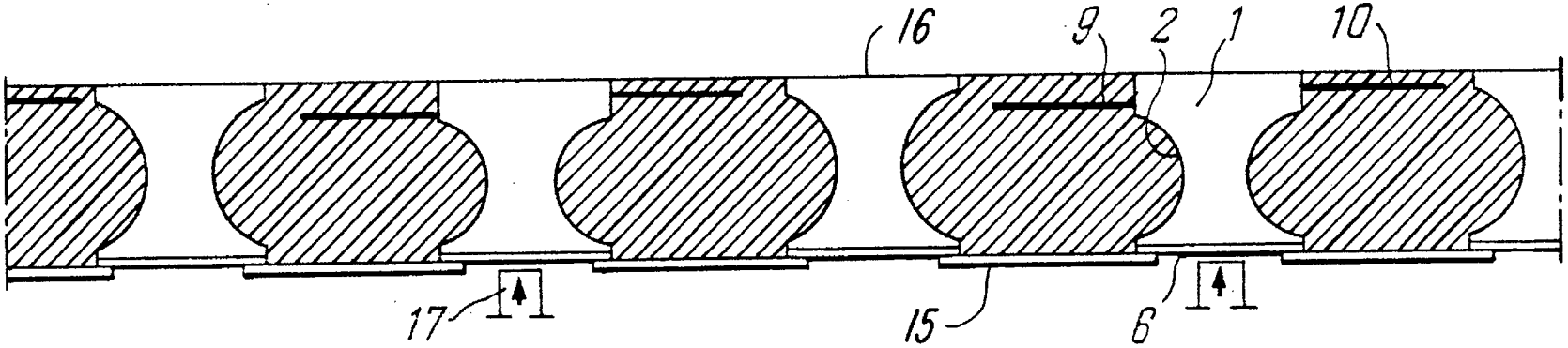
FIG. 11 is the wall with discretely arranged linking structures.

FIG. 11 shows a wall in ground, whose ability to be acted upon by a transverse bending moment is provided by the fact that the tensile stresses on the side of the face 16 originate in the zone of arrangement of linking structures 17 where they are accepted by the free lengths 9, 10 and the transverse moments originate between the linking structures, which stretch the sheet reinforcement 6 and the straps 15.

The above-described sequence of operations makes it possible to erect a sectional-monolithic wall of the claimed design with continuous reinforcement which exerts a positive effect on reliability of the erected structure due to higher lateral stiffness and ability to take transverse bending moments while the installation of the reusable prefabricated member without free lengths of reinforcing bars in the capacity of the last prefabricated member in the digging run makes for mechanizing the process of excavation in the next (subsequent) digging runs while replacement of said reusable prefabricated member by the prefabricated member 1 with free lengths 9, 10 of the lateral reinforcing bars in combination with the above-described sequence of concreting the monolithic portions of the wall without exception, retaining the required minimum number of type-sizes of the prefabricated members. These factors make the method for erecting the sectional monolithic wall in ground highly effectual by saving the erection time, reducing the amount of the required material and labour, increasing the wall strength without complicating the method of its erection expressed, i.e. simplifying the excavation of ground, using mechanization both for building of new structures and for repairs, strengthening and restoration of existing structures.

The factory-made prefabricated members produced from structural concrete with the walls built by underwater concreting. Offsetting of the curvilinear slot increases resistance of the wall to bending moment stretches the external sheet reinforcement facilitates the process of dismantling the block formwork, simplifies the design, speeds up the turnover of the formwork parts, and simplifies waterproofing of the wall. The design of the prefabricated member provides for easy interconnection of the members by welding transverse covering straps (not shown in the drawings) to the external sheet reinforcement or by all-round metal insulation which, together with the free lengths at the side of the thicker projections, produces a wall with continuous lateral reinforcement thus stepping up reliability of the fencing structure under the effect of horizontal loads.

The disclosed invention can be utilized in reconstruction of the existing and erecting of new foundations and underground structures with shallow foundation depth built from sectional monolithic walls in ground.

We claim:

1. A prefabricated member (1) of a sectional monolithic wall in ground comprised of a reinforcing cage and a concrete body with longitudinal curvilinear slots (2) on end faces, characterized in that the longitudinal curvilinear slots (2) are offset towards one of the longitudinal sides of the body and form thicker (3) and thinner (4) projections, the reinforcing cage consists of external sheet reinforcement (6) disposed on the external surface of the longitudinal side of the body at the side of thinner projections, tiers of transverse bars (7) extending through the height of the body, bars (5) disposed at the longitudinal side of the body on the side of the thicker projections and intersecting in each tier, said bars (5) having bends at the ends which are welded at the side of thinner projections to the external sheet reinforcement (6) while at the side of thicker projections they are secured to transverse bars (7).

2. The prefabricated member (1) of the sectional monolithic wall in ground according to claim 1, characterized in that the reinforcing cage has longitudinal prestressed reinforcing bars (8) disposed between the intersecting bars (5) and the external sheet reinforcement (6).

3. The prefabricated member of the sectional monolithic wall in ground according to claim 2, characterized in that the external sheet reinforcement (6) has free lengths (11) protuding out of the body contours for connection with the free lengths of a similar sheet reinforcement (6) of the adjacent prefabricated members of the wall.

4. The prefabricated member (1) of the sectional monolithic wall in ground according to claim 1, characterized in that the transverse bars (7) in each tier have free lengths (9,10) protruding beyond the counteropposed thicker projections and are offset from one another.

5. The prefabricated member of the sectional monolithic wall in ground according to claim 4, characterized in that the external sheet reinforcement (6) has free lengths (11) protuding out of the body contours for connection with the free lengths of a similar sheet reinforcement (6) of the adjacent prefabricated members of the wall.

6. The prefabricated member of the sectional monolithic wall in ground according to claim 1, characterized in that the external sheet reinforcement (6) has free lengths (11) protruding out of the body contours for connection with the free lengths of a similar sheet reinforcement (6) of the adjacent prefabricated members of the wall.

7. A sectional monolithic wall in ground comprising prefabricated members (1) with curvilinear longitudinal slots on end faces, installed at a distance from one another, and concreted monolithic portions (14) of the wall, disposed between the pair of adjacent prefabricated members (1), characterized in that the prefabricated members (1) have external sheet reinforcement (6) on one slotless side and free lengths (9,10) of transverse bars (7) on one longitudinal side of a body, located at the side remotely located from the side with the sheet reinforcement (6), the free lengths (9, 10) of the bars (7) of the adjacent prefabricated members (11) being inserted into the concreted monolithic portions (14) of the wall with overlapping and forming a continuous lateral reinforcement.

8. The sectional monolithic wall in ground according to claim 7, characterized in that it has covering straps (15) overlapping the monolithic portions (14) and secured to the sheet reinforcement (6) of the prefabricated members (1).

9. The sectional monolithic wall in ground according to claim 7, characterized in that it has additional prefabricated members (18) in the form of separating blocks with centrosymmetrical slots on counter-opposed sides, said additional prefabricated members (18) in the form of separating blocks alternating with at least one basic prefabricated member (1) while basic prefabricated members (1) are provided with devices for fastening linking structures (17).

10. A method for erecting a sectional monolithic wall in ground comprising the steps of:

digging a trench (19) by runs (20), manufacturing prefabricated members (1) and reusable prefabricated members (21), installing, in each digging run (20) at a distance shorter than the total length of free lengths (9,10) a lateral reinforcement, the prefabricated members (1) with curvilinear slots (2) on counteropposed sides, installing, at the edge of the run (20), the reusable prefabricated member (21) without the free lengths of the lateral reinforcement, concreting between pairs of the adjacent prefabricated members (1) monolithic portions (14), excavating the ground of a next run (23), installing therein the corresponding prefabricated members (1), extracting the reusable prefabricated member (21) from the previous run (20), installing said reusable prefabricated member (21) at the end of the next run (23), installing the prefabricated member (1) in its place, concreting the monolithic portions of wall (24, 25) adjoining said prefabricated member (1), concreting the monolithic portions (14) between the prefabricated members (1) in the subsequent run (23).

11. The method according to claim 10, comprising the additional steps of securing straps (15) to a sheet reinforcement (6) of the adjacent prefabricated members (1), as ground (13) is excavated, so as to completely or discretely overlap the monolithic portions of the wall (14, 24, 25).

* * * * *